US005335629A

United States Patent [19]

Cornic

[11] Patent Number: 5,335,629

[45] Date of Patent: Aug. 9, 1994

[54] PREHEATING STEAM GENERATOR

[75] Inventor: Gil Cornic, Aubergenville, France

[73] Assignee: FRAMATOME, Courbevoie, France

[21] Appl. No.: 991,354

[22] Filed: Dec. 15, 1992

[30] Foreign Application Priority Data

Dec. 19, 1991 [FR] France ..... 91 15800

[51] Int. Cl.[5] ..... F22B 1/02

[52] U.S. Cl. ..... 122/32; 376/402

[58] Field of Search ..... 376/402, 299, 211; 122/32, 443; 165/112, 117

[56] References Cited

U.S. PATENT DOCUMENTS 4,200,061 4/1980 Sterk et al. ..... 122/32

4,357,908 11/1982 Yazidjian ..... 122/32

5,104,611 4/1992 Woods et al. ..... 376/203

5,110,538 5/1992 Pascal et al. ..... 376/402

*Primary Examiner*—Donald P. Walsh

*Assistant Examiner*—Meena Chelliah

*Attorney, Agent, or Firm*—Pollock, Vande Sande & Priddy

[57] ABSTRACT

In a preheating steam generator, the secondary water is introduced into a preheating space (34) by deformable extensions (52) from inverted J tubes (50) fixed to a semi-torroidal supply collector (48). The structure may be in the form of three tubular segments interconnected by swivel connections or couplings. The fitting of the extensions (52) between the tubes (50) and a plate (54) partly upwardly sealing the preheating space (34) is ensured by dismantable fixing members, without any welding.

10 Claims, 4 Drawing Sheets

PREHEATING STEAM GENERATOR

FIELD OF THE INVENTION

The invention relates to a preheating steam generator for use in a pressurized water nuclear reactor.

BACKGROUND OF THE INVENTION

As illustrated by FR-A-2 477 265, a preheating steam generator equipping a nuclear power station conventionally comprises a vertically axial, outer envelope, whose inner space is divided into two parts, by a horizontal plate known as a tube plate. The ends of the tubes of a bundle of inverted U tubes are fixed to the tube plate and issue below the latter respectively in an entrance collector and in a discharge or exit collector for the water flowing in the primary circuit of the reactor, known as primary water. The water circulating in the secondary circuit of the reactor, referred to as feed or secondary water, is injected into the part of the steam generator positioned above the tube plate by a semi-toroidal feed collector positioned slightly above an inner envelope covering the tube bundle and having a lower edge spaced from the tube plate. More specifically, the secondary water passes out of the feed collector by inverted J feed tubes, whose lower end issues into a preheating space formed below the feed collector, between the inner envelope and a skirt partly surrounding the latter. This preheating space is located above the primary fluid discharge collector.

As a result of this arrangement, the secondary water introduced in the liquid state into the preheating space is progressively preheated as it descends and before it rises again into the inner envelope along the tubes of the bundle and then vaporizes on contact therewith. The steam thus formed traverses water/steam separating means located in the upper part of the outer envelope before leaving the steam generator. The effect of preheating the secondary water in the preheating space is mainly obtained by the water leaving the water/steam separators and known as recirculation water, which descends again between the outer envelope and the inner envelope, partly through the preheating space.

FR-A-2 644 926 proposes an improvement to such a preheating steam generator, which is directed to preventing the secondary water leaving the inverted J feed tubes from rising again above the feed collector under the effect of eddies, which tend to occur in the upper part of the preheating space. One of the constructional embodiments proposed for preventing the secondary water from re-rising consists of partly blocking or obstructing the top of the preheating space by a horizontal plate fixed to the inner envelope and by extending the inverted J feed tubes, in such a way that they traverse this plate and issue directly below the latter into the preheating space.

Although this solution makes it possible to solve the problem caused by the rising again of the secondary water above the feed collector, its construction leads to a certain number of problems.

Thus, the upper part of steam generators containing the water/steam separators and the secondary water feed collector is manufactured separately from the lower part containing the bundle of tubes, the inner envelope covering the same and the skirt partly surrounding the inner envelope. The two parts of the outer envelope are then welded together. The positioning of extensions for the inverted J feed tubes only takes place after hydraulic testing of the secondary side of the steam generator. For this purpose, manholes are provided in the outer envelope, to enable workers to enter the envelope. However, the fixing of extensions of tubes by welding at this stage of manufacture is difficult to accept, because it may lead to polluting deposits on the tube plate.

Moreover, the two-part manufacture of steam generators, combined with manufacturing tolerances, leads to axial misalignments of different values for each assembly formed by an inverted J feed tube and the corresponding perforation formed in the anti-return plate. The fitting of each of the extensions consequently requires the use of dummies making it possible to take measurements on each of these assemblies, so as to adapt each extension to the assembly corresponding thereto. This leads to a significant time loss, which is difficult to accept at this stage of manufacture, where deadlines are generally very tight.

To these problems encountered during the manufacture of the steam generator are added mechanical behavior and strength problems when the apparatus is operating. Thus, the differential expansions which occur, particularly between the operating periods, of the reactor and the shutdown periods may lead to breaks in the extensions.

SUMMARY OF THE INVENTION

The invention specifically relates to a preheating steam generator, in which the supply of the preheating space from inverted J supply tubes takes place by means of extensions whose original design makes it possible to adapt each extension to the configuration encountered during installation, so that any risk of breaks during the use of the steam generator are obviated.

According to the invention, this result is obtained by means of preheating steam generator comprising:

- a vertically axial, outer envelope;
- a horizontal tube plate tightly fixed to the interior of the outer envelope;
- a bundle of inverted U tubes, each having two ends fixed to the tube plate and issuing below the latter, respectively into a primary fluid entrance collector and a primary fluid exit collector;
- an inner envelope covering the bundle of tubes and having a lower edge spaced from the tube plate;
- a skirt partly surrounding the inner envelope and defining with the latter a preheating space partly closed in the upward direction by an anti-return plate;
- means for supplying the preheating space with secondary water, comprising a feed collector placed above the preheating space, inverted J feed tubes fixed to the supply collector and extensions connected to the supply tubes and to the anti-return plate; and
- means for extracting secondary steam through the upper parts of the inner and outer envelopes;

each of the extensions having a deformable structure.

By giving a deformable structure to the extensions, it becomes easily possible to take account during the installation of the extensions of the particular configuration encountered, without it being necessary to use dummies or carry out prior measurements. Moreover, the deformable character of the extensions enables them to withstand the differential expansions which may occur between the secondary water feed collector and the anti-return plate when the steam generator is operating.

Moreover, in order to avoid welding during installation, each of the extensions is preferably installed between one of the supply tubes and the anti-return plate in such a way that a first end of the extension is able to slide along its axis and a second end of the extension is fixed by mechanically dismantlable fixing means.

In this case, the first end of the extension is advantageously a top end to which is fixed a sleeve slidingly received on the supply tube. The second end of the extension is then a bottom end, connected by dismantlable fixing means to an end fitting, which is preferably divergent, which traverses the anti-return plate and is fixed to the latter.

In a preferred embodiment of the invention, the dismantlable fixing means advantageously comprise a screwed connection, whereof a rotary element is trapped on a beaten flange formed on the second end of the extension.

The deformable character of the extensions can in particular be obtained by producing each of them with the aid of at least three tubular segments, interconnected by swivel connections.

In order to avoid a possible problem of overall dimensions for the swivel connections closest to the feed tubes, the connections are heightwise displaced between adjacent extensions.

BRIEF DESCRIPTION OF THE DRAWINGS

The invention will now be described in greater detail relative to several embodiments and with reference to the attached drawings.

DETAILED DESCRIPTION

Figure 1:
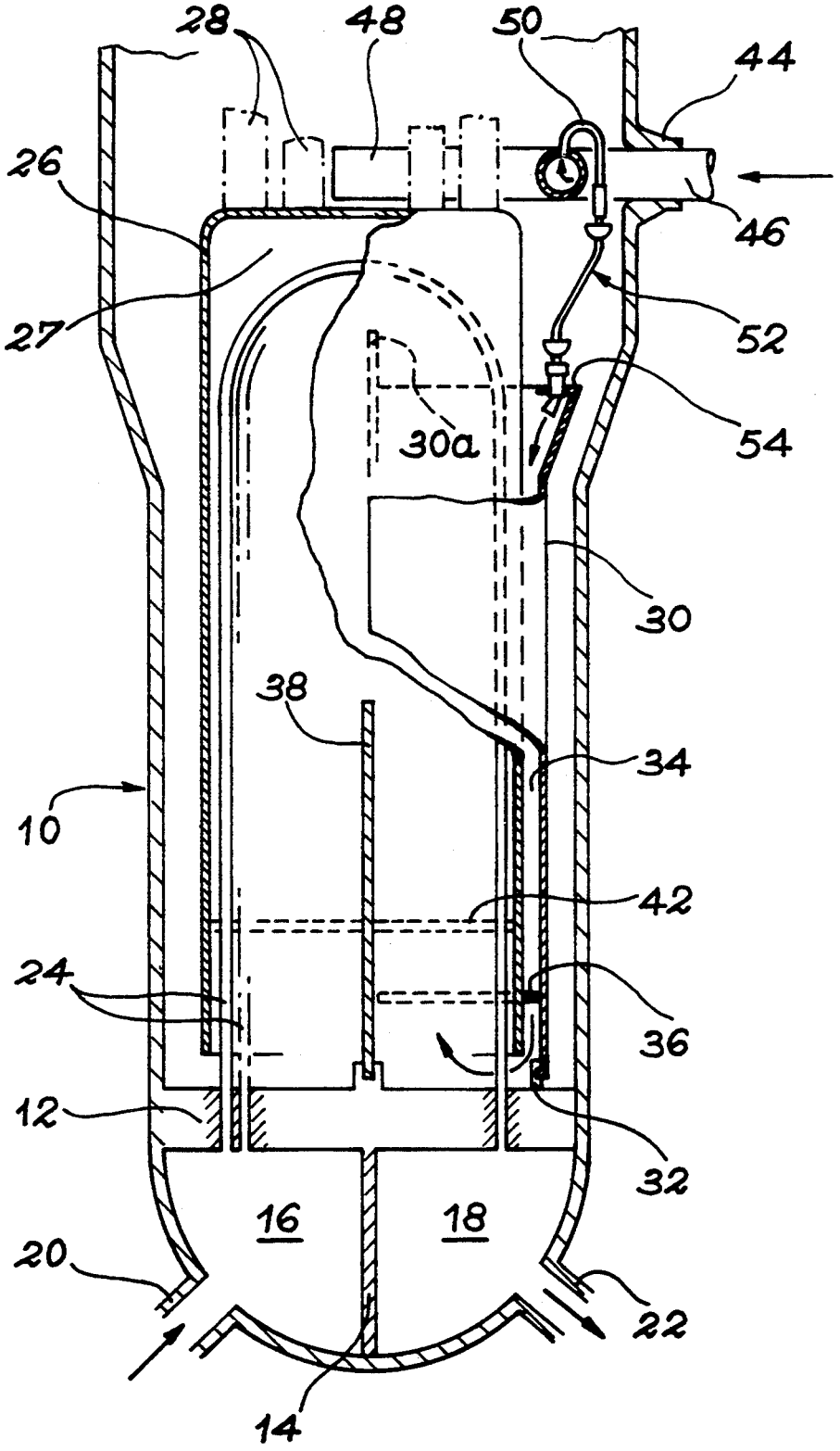
FIG. 1 is a side view, partly in section, schematically illustrating part of a steam generator constructed in accordance with the invention.

FIG. 1 shows the vertically axial outer envelope of revolution 10 of a steam generator for transferring heat between the primary water circuit and the secondary water/steam circuit of a pressurized water nuclear reactor. The envelope 10 defines a closed inner space, which is subdivided into a primary lower zone and a secondary upper zone by a horizontal tube plate 12 tightly connected to the envelope 10.

A vertical partition 14 subdivides the primary lower zone, normally called the water box, into an entrance collector 16 and an exit collector 18 for the water circulating in the primary circuit of the reactor. Pipes 20 and 22, welded to the outer envelope 10 of the steam generator, respectively connect the collectors 16 and 18 to the primary circuit.

A bundle of inverted U tubes 24 is tightly connected to the tube plate 12, in the secondary upper zone defined by the latter, in such a way that both ends of each of the tubes respectively issue into the entrance collector 16 and into the exit collector 18.

The bundle of tubes 24 is surrounded and covered by an inner envelope 26 positioned coaxially in the outer envelope 10. The upper horizontal wall of the inner envelope 26 is traversed by water/steam separators 28, which link the space 27 provided within the envelope 26 to a steam discharge pipe (not shown) at the top of the outer envelope 10. The lower edge of the inner envelope 26 is placed at a distance above the tube plate 12, so as to form a passage between the annular space defined between the envelopes 10 and 26 and the space 27 within the envelope 26.

Moreover, the steam generator according to the invention has a skirt 30 with a semicircular cross-section, which surrounds that part of the inner envelope 26 positioned vertically of the exit collector 18 and in which are placed the downward branches, known as cold branches, of the tubes 24. More specifically, the skirt 30 is terminated at each of its circumferential ends by two radial partitions **30*a* (FIG. 2), which are tightly connected to the inner envelope 26. The skirt 30 extends over most of the height of the inner envelope 26 and its lower edge is connected to the tube plate 12 by a semi-tight connection 32**.

Thus, between the skirt 30 and the inner envelope 26 is defined a preheating space 34, which is open towards the top and linked with the inner space 27 by the passage formed between the lower edge of the inner envelope 26 and the tube plate 12.

The upper part of the skirt 30 has an upwardly widened, frustoconical shape, in order to remain parallel to the outer envelope 10, which at this level has a frustoconical portion connecting the lower cylindrical portion to the upper cylindrical, but larger diameter portion of the envelope.

A perforated horizontal plate 36 is connected to both to the inner envelope 26 and the skirt 30 in the bottom part of the space 34, so as control the admission flow rate of the secondary water into inner space 27.

In the inner portion of the space 27 formed in the lower envelope 26, a vertical plate 38 is placed in the extension of the partition 14 in order to separate the two branches of the tubes 24 of the bundle. The plate 38 is mounted on the tube plate 12 by a semi-tight connection 40 and rises approximately to mid-height in the space 27. This plate 38 makes it possible to channel the secondary water leaving the preheating space 34 along the cold branches of the bundle of tubes 24 when this water enters the space 27. It therefore guarantees adequate preheating of the secondary water before the latter flows into the entire inner space 27 around the tubes 24.

In the bottom part of the space 27 and on either side of the vertical plate 38 is placed a horizontal distribution plate 42, which is traversed by the tubes 24 and is perforated so as to ensure substantially uniform radial distribution of the secondary water flow rates from top to bottom in the space 27.

The secondary water is introduced into the upper secondary zone of the steam generator by a pipe 44 tightly connected to the outer envelope 10, in a large diameter upper portion of the latter located at a level between the upper edge of the skirt 30 and the upper partition of the inner envelope 26. This pipe 44 is extended within the envelope 10 by a duct 46 which issues into a semi-torroidal supply collector 48 positioned above the supply space 34, as illustrated more particularly in FIG. 2.

Inverted J-shaped supply tubes 50 are connected at the top of the semi-torroidal collector 48 and descend in a substantially vertical direction outside this collector. The lower end of each of the supply tubes 50 is located at a low level at the bottom of the collector 48 and is connected by an extension 52 to an anti-return plate 54. The latter is a horizontal plate tightly fixed to the upper edge of the skirt 30 and extending above the preheating space 34 over the entire circumferential length of this space, i.e., approximately semi-circularly. Plate 54 has a uniform width, at most equal to approximately half the width of the preheating space 34 level with the upper edge of the skirt 30.

The general operation of this steam generator is the same as that of existing steam generators.

Thus, the water of the primary circuit flows from the entrance collector 16 to the exit collector 18 passing through tubes 24. Simultaneously, the secondary water introduced through pipe 44 is injected at the top of the preheating space 34 by supply tubes 50 through extensions 52 and descends to the bottom of the space 34, where it is preheated by the recirculation water passing out of the water/steam separators 28. The preheated feed water then circulates from bottom to top in the space 27 and is progressively distributed over the entire cross-section of the latter until it reaches its vaporization temperature. The steam recovered in the top part of the space 27 then passes through the water/steam separators before being discharged by the pipe formed in the dome of the outer envelope 10.

The structure of the extensions 52 by which the supply tubes 50 are connected to the anti-return plate 54 will now be described in detail relative to FIGS. 2 to 4.

In order to solve installation problems and problems connected with the differential expansion occurring between the different components of the steam generator after start-up of the nuclear power station, each of the extensions 52 has a deformable structure instead of a rigid structure. In addition, the installation of the extensions 52 between the supply tubes 50 and the anti-return plate 54 takes place without welding, so as to avoid all pollution of the secondary part of the steam generator.

Figure 3:
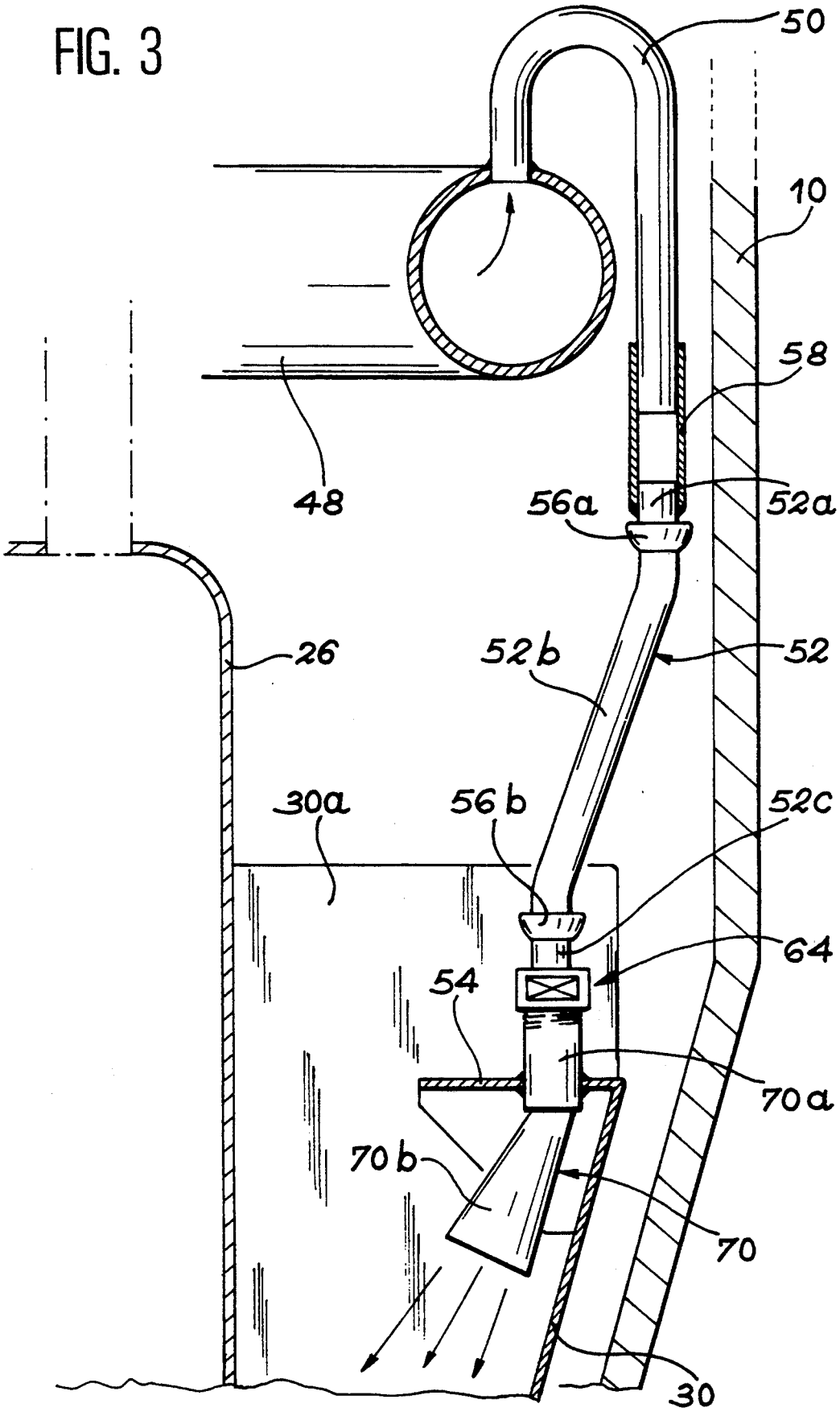
FIG. 3 is a larger scale view illustrating in partly sectional form one of the extensions connecting the end of an inverted J supply tube to the anti-return plate.

More specifically and as illustrated in FIG. 3, each of the extensions 52 is constituted by three tubular segments **52*a*, 52*b* and 52*c*, interconnected by two swivel connections 56*a* and 56*b*. The upper segment 52*a* of each extension 52, which is of limited length, is substantially rectilinear and fitted, prior to its installation within the steam generator, in a sleeve 58 welded to section 52*a* and extended beyond its end, so that it can be slidingly fitted onto the lower end of any random inverted J-shaped supply tube 50. The internal diameter of the sleeve 58 is dimensioned so as to permit easy installation on the end of the supply tube 50**, while reducing leakage risks at this level to the greatest possible extent.

When the extension 52 is put into place, this arrangement makes it possible to position the upper section **52*a* in alignment with the downward branch of the corresponding supply tube 50, i.e., in a substantially vertical direction, and allows relative axial displacement between the section 52*a* and the supply tube 50** when differential expansions occur within the steam generator.

The lower section **52*c* of each of the extensions 52 is also rectilinear and of limited length. Like the upper section 52*a*, it is oriented substantially vertically within the steam generator following its fixing to the anti-return plate 54**.

Figure 4:
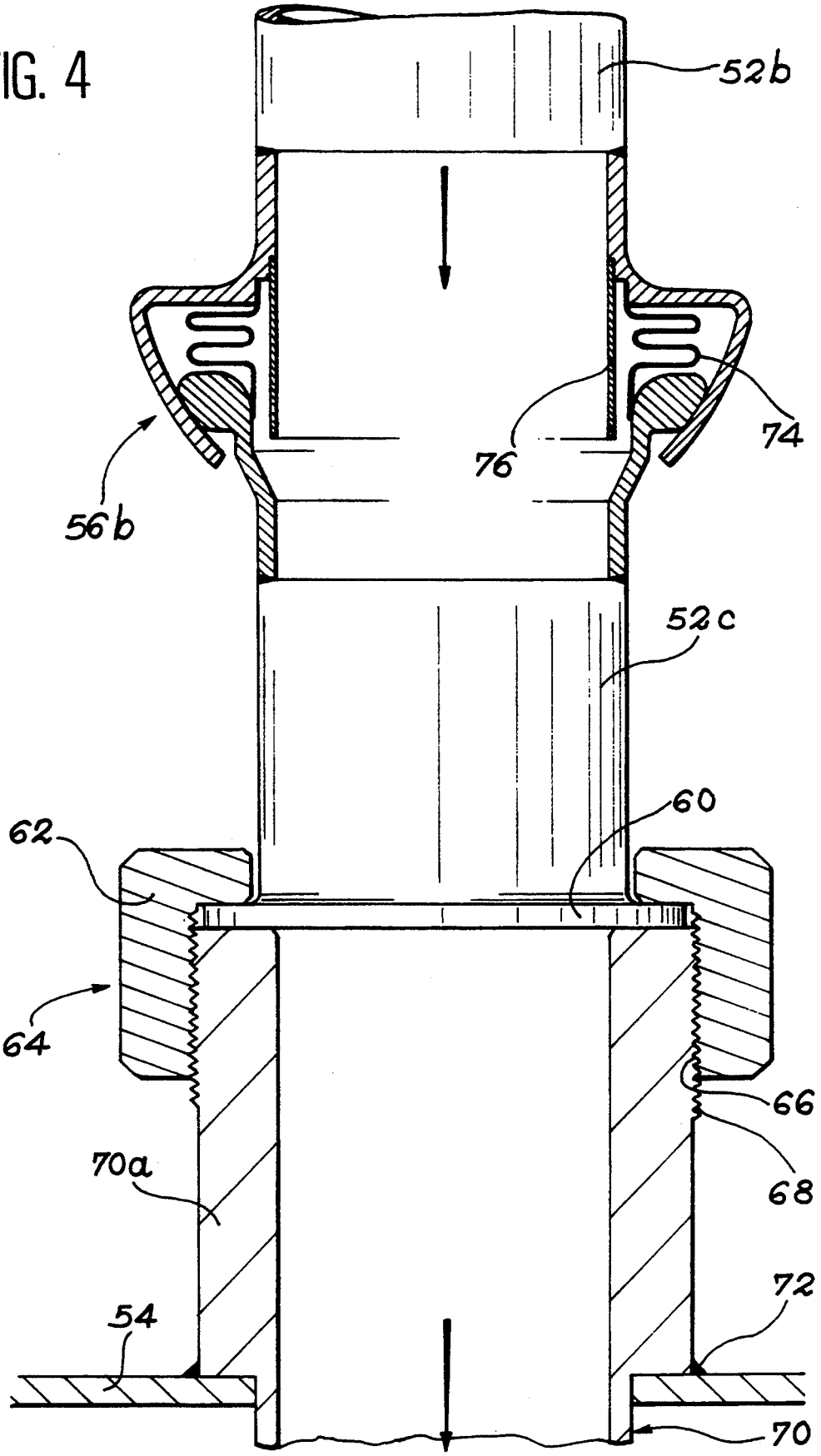
FIG. 4 is a sectional view showing on an even larger scale the lower part of an extension connected to the anti-return plate.

As is more specifically illustrated by FIG. 4, lower section **52*c* is terminated at its bottom end by a beaten flange 60 securing around section 52*c* a rotary ring 62, which forms the nut element of a screwed connection 64 by which the lower end of the extension 52 is fixed to the anti-return plate 54. For this purpose, the rotary ring 62 has, in a portion able to project below the beaten flange 60, an inner tap 66, which can be screwed onto a thread 68 formed at the upper end of a tubular end fitting 70 fixed to the anti-return plate 54 by a weld 72 prior to the assembly of the lower and upper portions of the steam generator. This tubular end fitting 70 has a substantially vertically axial upper portion 70*a* which traverses the anti-return plate 54 and extends downward the tubular lower segment 52*c* of the extension, as well as a divergent lower portion 70*b* (FIG. 3**), whose axis is oriented radially towards the inside of the steam generator.

The deformable nature of the structure formed by each of the extensions 52, linked with the presence of swivels **56*a* and 56*b*, as well as the fitting of the extension between the supply tube 50 and the anti-return plate 54, respectively, with the aid of the sliding sleeve 58 and the screwed connection 64, make it possible to fit the extensions without welding, no matter what alignment deficiency exists between the lower end of the supply tube and the upper end of the corresponding end fitting 70. For this purpose, the operator initially threads the sleeve 58 onto the lower end of the supply tube 50 and then fixes the bottom end of the extension onto the end fitting 70 with the aid of the screwed connection 64**.

The intermediate section **52*b* of each of the extensions 52 constitutes the longest portion of the latter and has, after installation, an inclination and an orientation varying between individual extensions, as a function of the alignment deficiency existing between the assembly of the end of each supply tube 50 and fitting 70**.

The swivel connections **56*a* and 56*b* are identical and, as illustrated by FIG. 4, for the connection 56*b*, each of them is advantageously provided with an inner sealing bellows 74 preventing any leakage risk and a tubular deflector 76 positioned within the bellows and fixed to the extension section located above the swivel connection in question, i.e., respectively the sections 52*a*, 52*b* for the swivel connections 56*a*, 56*b***.

Each of the swivel connections **56*a*, 56*b*** allows a relative angular displacement between the sections of the extensions connected by it, and this occurs in all directions by a maximum value, which can be 4°.

Figure 2:
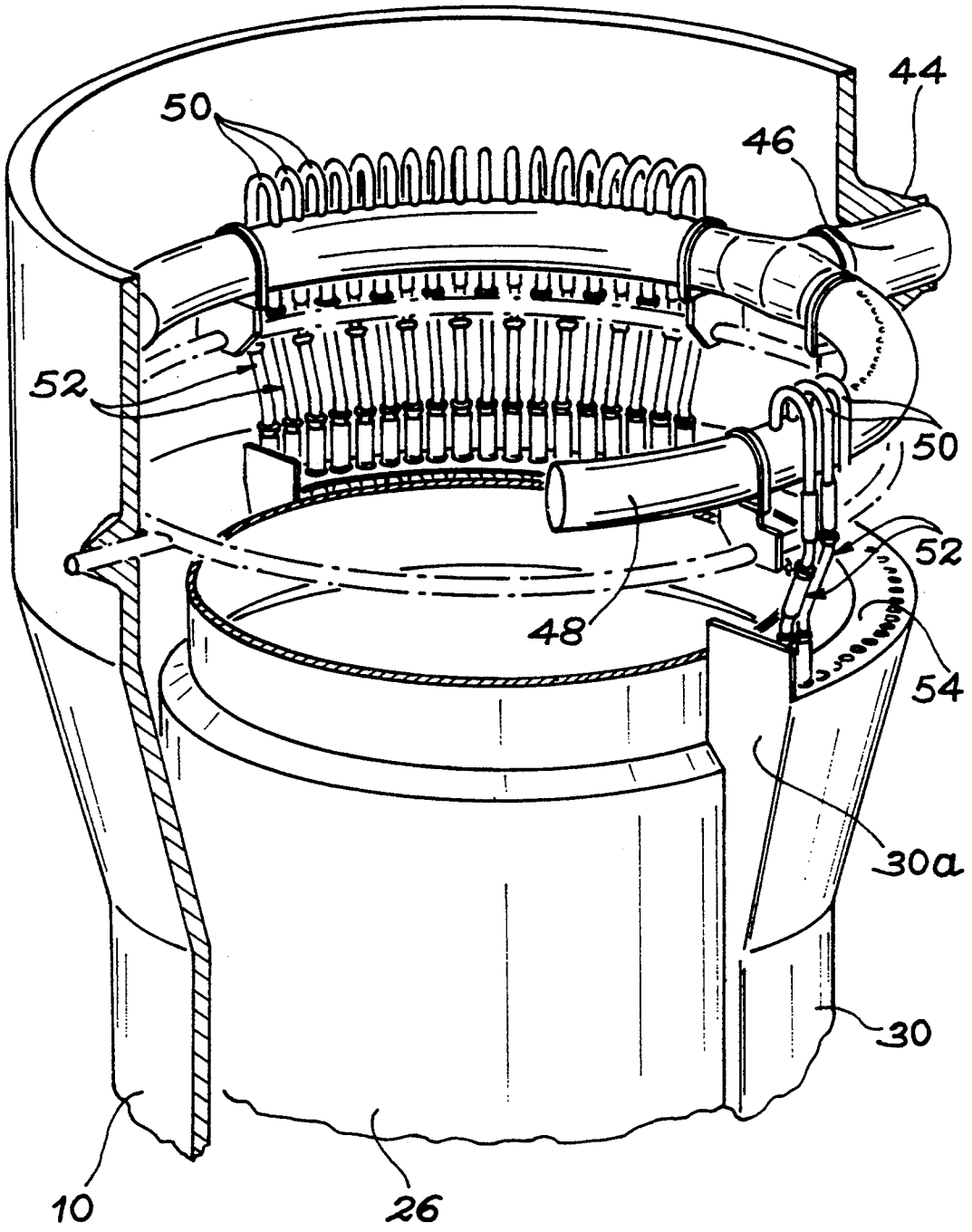
FIG. 2 is a partly sectional perspective view showing on a larger scale the central part of the steam generator by which the secondary water enters the latter and is then introduced into the preheating space.

As in more particularly illustrated by FIG. 2, the extensions 52 are advantageously of two different types, an extension of a given type being placed between two extensions of the other type. The only difference between the two types of extensions relates to the location of the upper swivel connection **56*a* closest to the supply tubes 50**.

In a first type of extension, the upper sections **52*a* are perfectly rectilinear and the intermediate sections 52*b* have at each of their ends an inwardly curved portion. The second type of extension 52 has an upper section 52*a* formed by a rectilinear portion extended downwards by an inwardly curved portion, whereas the intermediate section 52*b*** only has an inwardly curved portion at its lower end.

This difference between the two types of extensions 52 has the consequence of bringing about a heightwise displacement of the swivel connections **56*a* between adjacent connections. This arrangement makes it possible to avoid any problem of overall dimensions in the case where the bottom ends of adjacent supply tubes 50** would be too close to permit the juxtaposed installation of two swivel connections.

The preceding description clearly shows the advantages resulting from the special construction of the extensions 52 according to the invention. In particular, it is clear that the putting into place of these extensions following the connection by welding of the upper and lower parts of the outer envelope 10 of the steam generator respectively carrying the feed collector 48 provided with the feed tubes 50 and the anti-return plate 54 equipped with the end fittings 70 is carried out, without any welding, in a particularly rapid manner and in such a way that it is possible to take into account variable alignment deficiencies necessarily existing between the lower end of each of the feed tubes 50 and the upper end of the corresponding end fitting 70.

Moreover, the original construction of the extensions 52 according to the invention optionally permits the dismantling and refitting of certain of these extensions during the life of the steam generator for reasons of accessibility to the final joint of the steam generator, which has been difficult to carry out in the past (operations on welds).

Finally, and as already stated, this structure enables the extensions 52 to withstand all differential expansions occurring in the steam generator during its life.

The deformable character of the extensions can be obtained in a different manner from that described, e.g., by increasing the number of sections forming the extensions, as well as the number of swivel connections linking the sections, or by at least partly producing the extensions in the form of an assembly of rings placed end-to-end and articulated to one another to form a continuously deformable tube. Moreover, the fitting means for the extensions between the supply tubes and the end fittings fixed to the anti-return plate can differ and can, e.g., be the reverse of what has been described, whereby the screwed connection can be placed between the supply tube and the extension, while the sliding sleeve is formed by the upper part of the end fitting fixed to the anti-return plate. The screwed connection can also be replaced by any equivalent dismantlable fixing means, such as a bayonet fixing system, permitting the rapid installation of the extensions.

I claim:

1. Preheating steam generator comprising:

(a) a vertically axed, outer envelope;

(b) a horizontal tube plate tightly fixed to an interior of said outer envelope;

(c) a bundle of inverted U tubes, each of said U tubes having two ends fixed to said tube plate and emerging below said tube plate, respectively into a primary fluid entrance collector and a primary fluid exit collector;

(d) an inner envelope covering said bundle of U tubes and having a lower edge spaced from said tube plate;

(e) a skirt partly surrounding said inner envelope and defining with said inner envelope a preheating space partly closed in an upward direction by an anti-return plate;

(f) means for supplying said preheating space with secondary water, said means comprising a supply collector placed above said preheating space, inverted J supply tubes fixed to said supply collector and extensions connected to said J supply tubes and to said anti-return plate; and (g) means for extracting secondary steam through upper parts of said inner and outer envelopes;

(h) wherein each of said extensions has a deformable structure.

2. Steam generator according to claim 1, wherein said of said extensions is fitted between one of said J supply tubes and said anti-return plate in such a way that a first end of said extension can slide along its axis and a second end of said extension is fixed by dismantable fixing means.

3. Steam generator according to claim 2, wherein said first end of the extension is a top end to which is fixed a sleeve received in sliding manner on said supply tube.

4. Steam generator according to claim 2, wherein said second end of said extension is a bottom end, connected by said dismantable fixing means to an end fitting traversing and fixed to said anti-return plate.

5. Steam generator according to claim 4, wherein said end fitting is divergent.

6. Steam generator according to claim 2, wherein said dismantable fixing means comprise a screwed connection having a rotary element confined on a beaten flange formed at said second end of said extension.

7. Steam generator according to claim 1, wherein each of the extensions comprises at least three tubular segments interconnected by swivel connections.

8. Steam generator according to claim 7, wherein said swivel connections closest to said supply tubes are heightwise displaced between adjacent extensions.

9. Preheating steam generator comprising:

(a) a vertically axed, outer envelope;

(b) a horizontal tube plate tightly fixed to an interior of said outer envelope;

(c) a bundle of inverted U tubes, each of said U tubes having two ends fixed to said tube plate and emerging below said tube plate, respectively into a primary fluid entrance collector and a primary fluid exit collector;

(d) an inner envelope covering said bundle of U tubes and having a lower edge spaced from said tube plate;

(e) a skirt partly surrounding said inner envelope and defining with said inner envelope a preheating space partly closed in an upward direction by an anti-return plate;

(f) means for supplying said preheating space with secondary water, said means comprising a supply collector placed above said preheating space, inverted J supply tubes fixed to said supply collector and extensions connected to said J supply tubes and to said anti-return plate;

(g) means for extracting secondary steam through upper parts of said inner and outer envelopes; and (h) wherein each of said extensions has a deformable structure and comprises at least three tubular segments interconnected by swivel connections.

10. Preheating steam generator comprising:

(a) a vertically axed, outer envelope;

(b) a horizontal tube plate tightly fixed to an interior of said outer envelope;

(c) a bundle of inverted U tubes, each of said U tubes having two ends fixed to said tube plate and emerging below said tube plate, respectively into a primary fluid entrance collector and a primary fluid exit collector;

(d) an inner envelope covering said bundle of U tubes and having a lower edge spaced from said tube plate;

(e) a skirt partly surrounding said inner envelope and defining with said inner envelope a preheating space partly closed in an upward direction by an anti-return plate;

(f) means for supplying said preheating space with secondary water, said means comprising a supply collector placed above said preheating space, inverted J supply tubes fixed to said supply collector and extensions connected to said J supply tubes and to said anti-return plate;

(g) means for extracting secondary steam through upper parts of said inner and outer envelopes; and (h) wherein each of said extensions has a deformable structure and comprises at least three tubular segments interconnected by swivel connections, and is fitted between one of said supply tubes and said J supply tubes and said anti-return plate in such a way that a first end of said extension can slide along its axis and a second end of said extension is fixed by dismantable fixing means.

* * * * *

UNITED STATES PATENT AND TRADEMARK OFFICE

CERTIFICATE OF CORRECTION

PATENT NO. : 5,335,629
DATED : August 9, 1994
INVENTOR(S) : Gil Cornic

It is certified that error appears in the above-indentified patent and that said Letters Patent is hereby corrected as shown below:

In column 8, claim 2, line 1, change "said" to --each--.

Signed and Sealed this

Twentieth Day of June, 1995

Bruce Lehman

*Attest:*

BRUCE LEHMAN

*Attesting Officer*

*Commissioner of Patents and Trademarks*